US006311739B1

(12) United States Patent
Thompson et al.

(10) Patent No.: US 6,311,739 B1
(45) Date of Patent: Nov. 6, 2001

(54) TECHNIQUE FOR MAINTAINING CALIBRATION FACTOR INTEGRITY IN AN ELECTRONICALLY CALIBRATED DISPENSER

(75) Inventors: Thomas A. Thompson, Spring Lake; William O. Richardson, Grand Haven; Richard Shunta, North Muskegon; Brain L. Brummel, Spring Lake, all of MI (US)

(73) Assignee: Bennett Pump Company, Spring Lake, MI (US)

( * ) Notice: Subject to any disclaimer, the term of this patent is extended or adjusted under 35 U.S.C. 154(b) by 0 days.

(21) Appl. No.: 09/632,471

(22) Filed: Aug. 4, 2000

Related U.S. Application Data

(60) Provisional application No. 60/156,635, filed on Sep. 29, 1999.

(51) Int. Cl.[7] ..... B65B 1/04

(52) U.S. Cl. ..... 141/94; 222/23; 222/52

(58) Field of Search ..... 141/94, 192, 98; 222/23, 30, 40, 47, 52; 702/50, 55

(56) References Cited

U.S. PATENT DOCUMENTS 4,482,964 * 11/1984 Berstein et al. .

5,920,829 * 7/1999 Bretmersky et al. .

* cited by examiner

*Primary Examiner*—Steven O. Douglas
(74) *Attorney, Agent, or Firm*—Price, Heneveld, Cooper, DeWitt & Litton

(57) ABSTRACT

An electronically calibrated fuel dispenser includes a processor located on a processor board, a fuel pump, a pulser circuit and a memory located on a memory board. The processor board includes a calibration factor connector. The fuel pump is coupled to a fuel source and includes a fuel meter. The fuel pump provides fuel to a fuel recipient. The pulser circuit is coupled to the fuel meter. The pulser circuit provides an indication to the processor of the fuel delivered to the fuel recipient. The memory board includes a connector for coupling the memory board to the calibration factor connector of the processor board and thereby coupling the memory to the processor. The memory stores calibration factors independent of the processor board. The memory board further includes a calibration mode entry device, a blocking device and a sealing device. The blocking device prevents the calibration mode entry device from being actuated when the blocking device is in a blocking position. The sealing device provides an indication of whether the blocking device has been removed from the blocking position without authorization and thereby providing an indication of whether the calibration mode entry device has been enabled without authorization. Thus allowing the processor board to be replace or removed without altering the calibration factors.

18 Claims, 2 Drawing Sheets

TECHNIQUE FOR MAINTAINING CALIBRATION FACTOR INTEGRITY IN AN ELECTRONICALLY CALIBRATED DISPENSER

This application claims priority based on U.S. Provisional Patent Application Serial No. 60/156,635 entitled, "TECHNIQUE FOR MAINTAINING CALIBRATION FACTORINTEGRITY IN A ELECTRONICALLY CALIBRATED DISPENSER", by Thomas A. Thompson et al., filed Sep. 29, 1999, the disclosure of which is hereby incorporated by reference.

BACKGROUND OF THE INVENTION

The present invention is directed to electronic calibration of a fuel dispenser and more particularly to maintaining calibration factor integrity in an electronically calibrated fuel dispenser.

Traditionally, fuel dispensers have been calibrated entirely through mechanical adjustment. As the cost of electronics has continued to decrease, manufacturers have implemented electronic circuitry to facilitate calibration of fuel dispensers. In a typical fuel dispenser, electronic calibration is performed through a setup menu that is under the control of a processor that controls various functions of the fuel dispenser. A primary function of the processor is to determine the quantity of fuel pumped. Utilizing electronic circuitry has generally simplified the calibration of fuel dispensers, since access to lower hydraulic areas of the fuel dispenser is not normally required.

In a typical electronically calibrated fuel dispenser, fuel meter calibration constants are detached from the fuel meter (i.e., stored in processor readable memory). In those fuel dispensers, the fuel meter calibration constants have not been tamper resistant. Additionally, current fuel dispensers have not normally retained fuel meter calibration constants when a processor board is replaced. That is, when a processor board fails, all fuel meters associated with a faulty processor board require recalibration.

SUMMARY OF THE INVENTION

The present invention is directed to an electronically calibrated fuel dispenser that maintains calibration factor integrity. The fuel dispenser includes a processor located on a processor board, a fuel pump, a pulser circuit and a memory located on a memory board. The processor board includes a calibration factor connector. The fuel pump is coupled to a fuel source. The fuel pump includes a fuel meter and provides fuel to a fuel recipient. The pulser circuit is coupled to the fuel meter. The pulser circuit provides an indication to the processor of the fuel delivered to the fuel recipient. The memory board includes a memory connector for coupling the memory board to the calibration factor connector of the processor board and thereby coupling the memory to the processor. The memory stores calibration factors independent of the processor board. The memory board further includes a calibration mode entry device, a blocking device and a sealing device. The blocking device prevents the calibration mode entry device from being actuated when the blocking device is in a blocking position. The sealing device provides an indication of whether the blocking device has been removed from the blocking position without authorization and thereby provides an indication of whether the calibration mode entry device has been enabled without authorization.

These and other features, advantages and objects of the present invention will be further understood and appreciated by those skilled in the art by reference to the following specification, claims and appended drawings.

DETAILED DESCRIPTION OF THE INVENTION

A technique according to the present invention allows fuel meter calibration factors and other constants to be retained when a processor board is replaced. This technique can advantageously retain all fuel dispenser constants associated with a fuel meter. A disclosed embodiment of the present invention provides for sealing the fuel meter calibration factors to a dispenser chasis.

A typical electronically calibrated fuel dispenser includes a pulser circuit. A pulser circuit is connected to each hydraulic meter by a mounting bracket and gear train assembly in a manner well known to those of ordinary skill in the art. Each pulser circuit typically outputs two channels of information and has a pulser disconnect line to allow detection of an unplugged pulser circuit. A typical pulser circuit includes a pulser wheel or disc that spins through two infrared beams that make and break two switching circuits. The pulser circuit provides this pulse data to a processor located on a processor board. The processor board decodes the data received from the pulser circuit to determine the quantity of fuel delivered. In a typical application, a pulser circuit, as previously described, is designed to provide approximately one thousand pulses per gallon.

Figure 1:
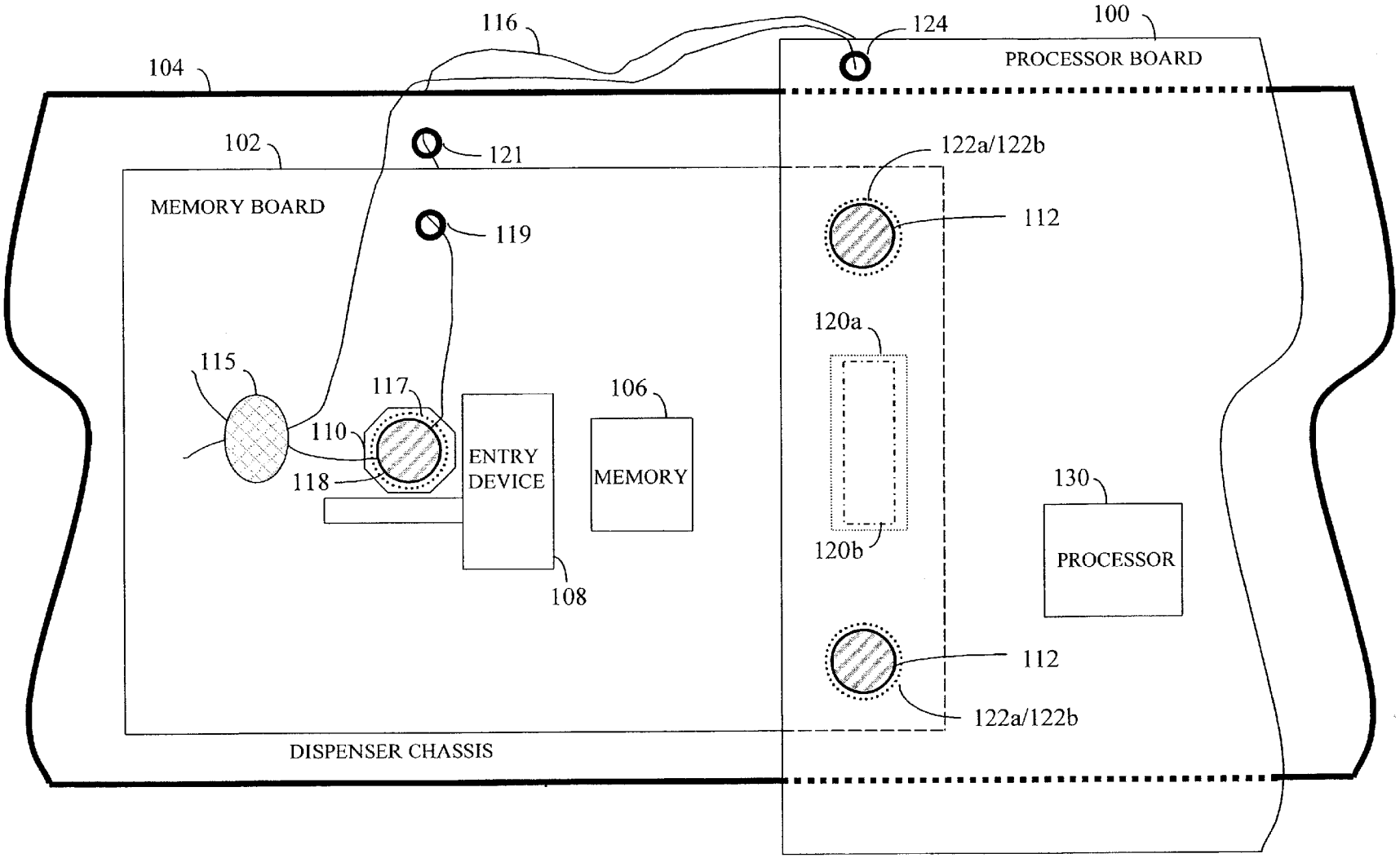
FIG. 1 is a view of an electronically calibrated fuel dispenser's processor board and memory board, according to an embodiment of the present invention.

FIG. 1 depicts a processor board 100 and memory board 102 configured according to an embodiment of the present invention. Processor board 100 includes a processor 130 and a calibration factor connector 120*a*. Memory board 102 includes a memory 106 and a memory connector 120*b*. Connectors 120*a* and 120*b*, when mated, couple processor board 100 to memory board 102 and thereby couple memory 106 to processor 130. In this context, the term processor may include a general purpose processor, a microcontroller (i.e., and execution unit with memory, etc. integrated within a single integrated circuit), a digital signal processor or a programmable logic array. Guides 112 insure proper mating of connectors 120*a* and 120*b*. Guides 112 can be mounted to a dispenser chasis 104. In this case, processor board 100 and memory board 102 each include a pair of holes 122*a* and 122*b*, respectively (for accepting guides 112). Alternatively, the guides 112 can be mounted to processor board 100 or memory board 102 (in this case, the board without guides 112 includes a pair of holes for accepting guides 112).

A nonvolatile memory 106 is located on memory board 102. Nonvolatile memory 106 can be of various types, such as an EEPROM or flash ROM. Memory board 102 also includes a calibration mode entry device 108. The calibration mode entry device 108 can be a switch that includes a key or lever (or other type of device that readily lends itself to blocking the actuation of calibration mode entry device 108 with a mechanical-type apparatus).

In the preferred embodiment, a threaded stud 118 is secured to dispenser chasis 104. Memory board 102 includes a hole 117 for accepting threaded stud 118. Threaded stud 118 is capable of receiving a blocking nut 110. Blocking nut 110, when in place, prevents actuation of calibration mode entry device 108. A sealing wire 116 is passed through dispenser chasis 104 (through a hole 121), memory board 102 (through a hole 119), threaded stud 118 (hole not shown) and blocking nut 110 (hole not shown). If desired, sealing wire 116 can also be passed through a hole 124 in processor board 100. Sealing wire 116 is then sealed with a lead tag 115. Thus, when blocking nut 110 is threaded onto threaded stud 118, with sealing wire 116 in place and sealed with lead tag 115, memory board 102 cannot be removed nor can the calibration factors stored in memory 106 be changed without breaking sealing wire 116.

One of skill in the art will readily appreciate that other sealable mechanical apparatus (blocking devices) can be utilized in place of threaded stud 118 and blocking nut 110 to block the actuation of calibration mode entry device 108. Further, one of skill in the art will appreciate that sealing devices other than a sealing wire 116 and lead seal 115 can be utilized. For example, lead seal 115 could be replaced with a plastic seal or any type of approved seal. Additionally, an adhesive seal tape, by itself, could be utilized as a sealing device.

A typical calibration procedure would involve a technician first placing a fuel dispenser in a calibration mode. This is accomplished by cutting sealing wire 116 and removing blocking nut 110. At that point, an operator can actuate the calibration mode entry device 108 such that calibration can be performed. The operator then actuates the fuel dispenser and pumps a quantity of fuel into a metered vessel. At the point, the operator enters the measured volume of the fuel into the fuel dispenser through a keypad 210 (see FIG. 2). A keypad decoder (not shown) provides the entered value to a processor 130 on processor board 100.

Processor 130 then executes a routine that, based upon the output of the pulser circuit and the measured volume entered by the operator, calculates a calibration factor and stores that calibration factor in memory 106. Calibration mode entry device 108 is then placed in the non-calibration mode. Blocking nut 110 is then threaded onto threaded stud 118. A new sealing wire 116 is then placed through a hole in blocking nut 110 (hole not shown), threaded stud 118 (hole not shown), in memory board 102 (hole 119), and dispenser chasis 104 (hole 121). Sealing wire 116 is then sealed with lead seal 115. Alternatively, processor board 100 can also be sealed (by also routing sealing wire 116 through hole 124).

Figure 2:
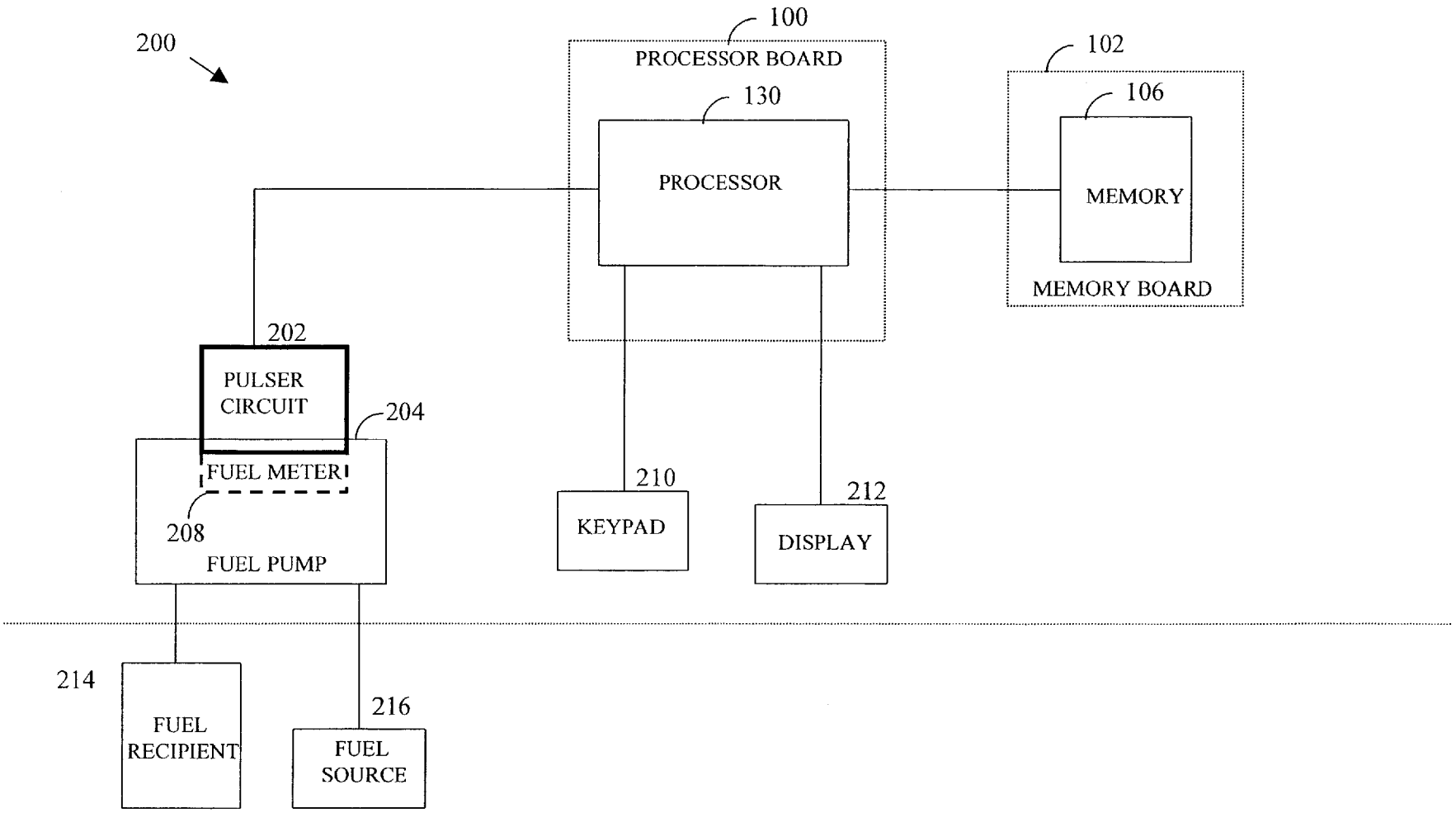
FIG. 2 is a block diagram of the electronically calibrated fuel dispenser, according to an embodiment of the present invention.

A block diagram of a fuel dispenser 200, according to an embodiment of the present invention, is illustrated in FIG. 2. A fuel source 216 is coupled to a fuel pump 204. A fuel recipient 214 is also coupled to fuel pump 204 (through a fuel supply hose). Fuel pump 204 delivers fuel to fuel recipient 214 at the direction of processor 130. Fuel pump 204 includes a fuel meter 208. Attached to fuel meter 208 is a pulser circuit 202. Pulser circuit 202 is coupled to processor 130 and provides processor 130 with an indication of the amount of fuel delivered to fuel recipient 214. As shown in FIGS. 1–2, processor 130 is located on processor board 100.

Processor 130 receives input from a user through a keypad 210 and provides output to the user through a display 212. As previously described, processor 130 is coupled to memory 106 on memory board 102 through a memory connector 120*b* and a calibration factor connector 120*a*. As discussed above, memory 106 retains calibration factors independent of processor board 100. Thus, when processor board 100 is removed for servicing, calibration factors are retained in memory 106. This is advantageous in that calibration factors do not have to be re-determined.

Thus, the above-described assembly provides a tamper resistance technique for retaining fuel meter calibration factors. At the same time, processor board 100 can be removed and replaced without recalibrating the fuel meter(s) in the fuel dispenser. As described above, the disclosed technique provides a tamper resistant electronic calibration assembly that will clearly indicate if memory board 102 has been tampered with. This advantageously provides an electronically calibrated fuel dispenser that includes a sealing wire and lead tag that is commonly required by various weights and measures authorities.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed:

1. An electronically calibrated fuel dispenser that maintains calibration factor integrity, comprising:

a processor located on a processor board, the processor board including a calibration factor connector;

a fuel pump coupled to a fuel source, the fuel pump including a fuel meter, the fuel pump providing fuel to a fuel recipient;

a pulser circuit coupled to the fuel meter, the pulser circuit providing an indication to the processor of the fuel delivered to the fuel recipient; and a memory located on a memory board, the memory board including a memory connector for coupling the memory board to the calibration factor connector of the processor board and thereby coupling the memory to the processor, the memory storing calibration factors independent of the processor board, the memory board further including:

a calibration mode entry device for enabling and disabling the writing of the calibration factors into the memory;

a blocking device, the blocking device preventing the calibration mode entry device from being actuated when in a blocking position; and a sealing device, the sealing device providing an indication of whether the blocking device has been removed from the blocking position without authorization and thereby providing an indication of whether the calibration mode entry device has been enabled without authorization.

2. The electronically calibrated fuel dispenser of claim 1, wherein the calibration mode entry device is a switch actuated by a key.

3. The electronically calibrated fuel dispenser of claim 1, wherein the calibration mode entry device is a switch actuated by a lever.

4. The electronically calibrated fuel dispenser of claim 1, wherein the blocking device includes a nut.

5. The electronically calibrated fuel dispenser of claim 1, wherein the sealing device includes a sealing wire and an approved tag.

6. The electronically calibrated fuel dispenser of claim 1, wherein the sealing device includes seal tape.

7. A tamper resistant electronic calibration assembly for maintaining calibration factor integrity of an electronically calibrated fuel dispenser, the fuel dispenser including a fuel pump, a fuel meter and a pulser circuit, the fuel pump being coupled to a fuel source and providing fuel to a fuel recipient, the pulser circuit being coupled to the fuel meter and providing an indication of the fuel delivered to the fuel recipient, the tamper resistant electronic calibration assembly comprising:

a processor board including a processor and a calibration factor connector;

a memory board including a memory and a memory connector, the memory connector for coupling the memory board to the calibration factor connector of the processor board and thereby coupling the memory to the processor, the memory storing calibration factors independent of the processor board, the memory board further including:

a calibration mode entry device for enabling and disabling the writing of the calibration factors into the memory;

a blocking device, the blocking device preventing the calibration mode entry device from being actuated when in a blocking position; and a sealing device, the sealing device providing an indication of whether the blocking device has been removed from the blocking position without authorization and thereby providing an indication of whether the calibration mode entry device has been enabled without authorization.

8. The tamper resistant electronic calibration assembly of claim 7, wherein the calibration mode entry device is a switch actuated by a key.

9. The tamper resistant electronic calibration assembly of claim 7, wherein the calibration mode entry device is a switch actuated by a lever.

10. The tamper resistant electronic calibration assembly of claim 7, wherein the blocking device includes a nut.

11. The tamper resistant electronic calibration assembly of claim 7, wherein the sealing device includes a sealing wire and an approved tag.

12. The electronically calibrated fuel dispenser of claim 7, wherein the sealing device includes seal tape.

13. A method for providing calibration factor integrity for an electronically calibrated fuel dispenser, comprising:

providing a processor located on a processor board, the processor board including a calibration factor connector;

providing a memory located on a memory board, the memory board including a memory connector for coupling the memory board to the calibration factor connector of the processor board and thereby coupling the memory to the processor, the memory storing calibration factors at the direction of the processor;

providing a calibration mode entry device on the memory board, the calibration mode entry device for enabling and disabling the writing of the calibration factors into the memory;

providing a blocking device on the memory board, the blocking device preventing the calibration mode entry device from being actuated when in a blocking position; and providing a sealing device, the sealing device providing an indication of whether the blocking device has been removed from the blocking position without authorization and thereby providing an indication of whether the calibration mode entry device has been enabled without authorization.

14. The method of claim 13, wherein the calibration mode entry device is a switch actuated by a key.

15. The method of claim 13, wherein the calibration mode entry device is a switch actuated by a lever.

16. The method of claim 13, wherein the blocking device includes a nut.

17. The method of claim 13, wherein the sealing device includes a sealing wire and an approved tag.

18. The method of claim 13, wherein the sealing device includes seal tape.

* * * * *